United States Patent [19]

Carlson et al.

[11] 3,930,560

[45] Jan. 6, 1976

[54] DAMPING ELEMENT

[75] Inventors: Elmer V. Carlson, Prospect Heights; August F. Mostardo, Jr., Norridge, both of Ill.

[73] Assignee: Industrial Research Products, Inc., Elk Grove Village, Ill.

[22] Filed: July 15, 1974

[21] Appl. No.: 488,300

[52] U.S. Cl. ..... 181/160; 179/180; 181/146; 181/158; 181/196

[51] Int. Cl.[2] ..... H04R 1/28; G10K 13/00; H04R 7/00

[58] Field of Search ..... 181/158, 160, 166, 156, 181/146, 196; 179/180, 190

[56] References Cited

UNITED STATES PATENTS

| | | | |
|---|---|---|---|
| 2,540,498 | 2/1951 | Tallman | 181/158 |
| 2,761,912 | 9/1956 | Tougcr et al. | 181/166 |
| 3,124,663 | 3/1964 | Beaudry | 181/158 |
| 3,381,773 | 5/1968 | Schenkel | 181/158 |
| 3,418,437 | 12/1968 | Hoffmann | 181/160 |

FOREIGN PATENTS OR APPLICATIONS

| | | | |
|---|---|---|---|
| 1,027,951 | 5/1966 | United Kingdom | 179/180 |

*Primary Examiner*—Stephen J. Tomsky
*Attorney, Agent, or Firm*—Leo J. Aubel

[57] ABSTRACT

A damping element comprising fiberous fuseable material shaped to form a cup-like member which may be inserted in the sound openings of an acoustic transducer to provide a selected acoustic resistance.

1 Claim, 10 Drawing Figures

DAMPING ELEMENT

BACKGROUND OF THE INVENTION

Acoustic resistances made of woven or etched mesh or screen are well known in the art. In such materials, the apertures can be made small, a condition necessary to produce acoustic impedances in which dissipative, resistance parameter substantially exceeds the reactive inertance parameter. Common in the prior art, the etched mesh or screen is cemented or clamped over an aperture to obtain an acoustic impedance having a relatively pre-determined value.

When metal screens or perforate mesh are used, it is relatively simple and inexpensive to form and shape such materials into useful devices or plugs for insertion into acoustic apparatus. Such devices are relatively sturdy but if once distorted, it is difficult to restore the devices to their original shape.

Accordingly, it is a feature and purpose of this invention to provide acoustic devices that are durable and can be conveniently handled and cleaned, inserted and removed from their operational locations without damage to the device.

Other types of acoustic plugs comprise plastic or metal bushings having a hole of selected size to provide a desired degree of closure to modify the frequency response in accordance with the wearer's requirements.

However, it has been found that when a single hole, or even a few holes formed in a concentrated area, are used to obtain the resistance, the sound, in order to pass through these holes, must converge to this small area. This action contributes an inertance component to the impedance limiting the quality of the acoustic element as a resistive element. If holes are produced in a less concentrated area, such as over the surface of the mesh, the movement of air in the sound is not forced to store as much energy in inertia to converge to the holes that produce the frictional component of impedance, thereby providing the result that the inertance component of the impedance is lower and the acoustic element provides a better resistance.

Also, if high intensity sound such as would occur at the outlet of a receiver is channeled through a single hole, or even through a few holes, there is a tendency for unwanted turbulence to develop.

Accordingly, it is another feature and purpose of the present invention to provide an acoustic plug which provides a selected acoustic impedance while developing no disruptive turbulence.

The foregoing and other features and advantages of the invention will be apparent from the following more particular description as illustrated in the accompanying drawings wherein:

DESCRIPTION OF THE DRAWINGS

FIG. 5A shows a mesh or screen in sheet form; FIG. 5B shows the acoustic element partially formed into its cylindrical construction; and FIG. 5C shows the acoustic element fully formed for insertion in an associated opening;

DESCRIPTION OF THE INVENTION

The present invention is directed to a damping element formed essentially in a cup-like or closed cylindrical form having the end of the cylinder formed as a mesh or matrix material which allows sound to pass therethrough. The acoustic resistance provided by said mesh to sound passing therethrough is selectively controlled to provide a desired dissipative resistance parameter. Because of the flexible nature of the materials used, the inventive acoustic element, if deformed, may be easily restored to its original shape such as by inserting the element over a mandrel. Thus, the inventive acoustic element may be shipped, inserted, removed, handled and cleaned without impairing its performance when it is reinserted in its operating position.

Figure 1:
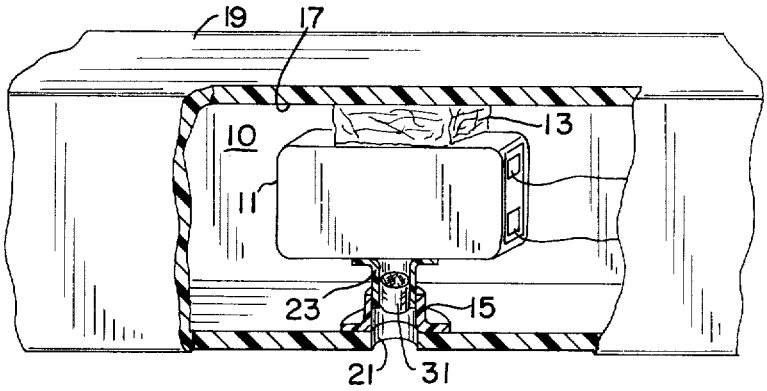
FIG. 1 is an isometric view of a microphone transducer mounted in an eye-glass type of hearing aid and showing an acoustic element in accordance with the invention mounted in an inlet opening to the microphone.

FIG. 1 shows one example wherein the inventive acoustic element 31 may be used. In FIG. 1 an eyeglass type of hearing aid assembly 10 includes a microphone 11, suitably mounted as by isolator mountings 13 and 15 within a chamber 17 formed in the temple piece 19 of the eyeglass. A sound opening 21 in the wall of the chamber 17 couples sound to a sound duct 23 of microphone 11.

An acoustic resistance element or plug 31 in accordance with the invention, may be located or positioned in the sound duct 23. As is known, acoustic element 31 provides a selected acoustic resistance to sound passing through duct 23.

Figure 2:
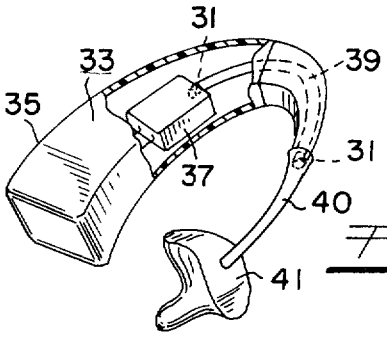
FIG. 2 is an isometric view of a behind-the-ear type of hearing aid showing a receiver transducer mounted in the hearing air and showing an acoustic resistance element mounted in the receiver output port leading through the acoustic channel to the ear cavity.

Another example of a usuage of the present invention is shown in FIG. 2 which depicts a behing-the-ear type of hearing aid assembly 33 including a receiver 37 mounted within a housing 35. As is known, sound is conveyed from the output of the receiver 37 through a sound channel or duct 39. A flexible tubing 40 and a suitable ear mold 41 couple the sound duct 39 to the ear cavity of the user. An acoustic element 31 in accordance with the invention, may, for example, be mounted at the outlet of the receiver 37 at the point which receiver connects to a channel 39, or at the end of channel 39 where it connects to the flexible tubing 40.

Figure 3:
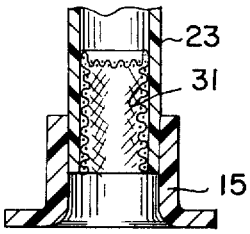
FIG. 3 is a relatively enlarged view of the inlet opening portion of FIG. 1 to better show the positioning of the acoustic element in accordance with the invention.
Figure 4:
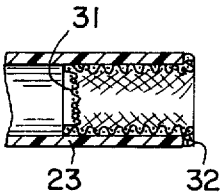
FIG. 4 is a view in cross section of an acoustic element in accordance with the invention which element has a mounting rim.

FIG. 3 is a relatively enlarged view showing the acoustic resistance element 31 positioned in sound duct 23. Note also that acoustic element 31 could be mounted in a relatively reverse orientation in FIG. 3. FIG. 4 shows an embodiment of the acoustic element 31 having an end rim or shoulder 32 which can abut the end of the sound duct 23 for positioning element 31 therein.

Figure 5A:
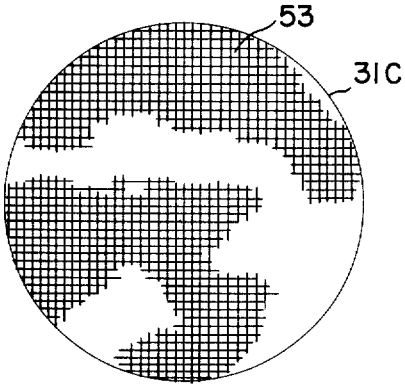
FIGS. 5A, 5B and 5C show an enlarged view of an acoustic element in accordance with the invention; more particularly
Figure 5B:
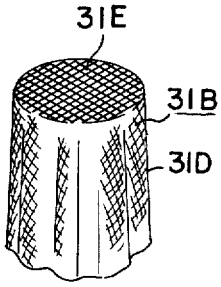
Figure 5C:
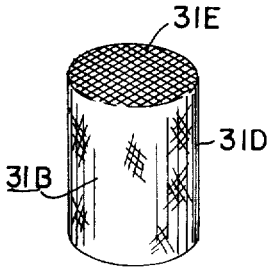

Refer now to FIGS. 5A, 5B and 5C for purposes of describing the structure of the acoustic resistance element 31 in accordance with the invention. The acoustic resistance element 31 comprises a woven mesh or matrix having fibers 53 of appropriate diameter and spacing. FIG. 5A shows sheet 31C from which the acoustic resistance element is formed. Sheet 31C may be of a thermoplastic material such as nylon or polyester, or a disolvable material such as acetate or rayon. As shown in FIG. 5B, the sheet 31C is folded into a cup-like member 31B having one end 31E capped or covered. Next, the sides or walls 31D of the cup-like member 31B are fused to form a less pervious sound wall or barrier, as shown in FIG. 5C. The end or aperture area 31E of the cup-like member comprises the effective acoustic resistance.

Figure 6:
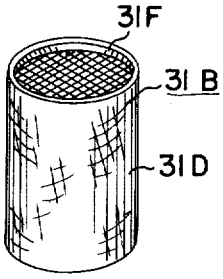
FIG. 6 shows another embodiment of the present invention wherein the acoustic element is formed in a cylindrical shape with the closed end of the cylinder having a portion of the material doubled back to form a reinforced rim around the acoustical aperture area.

FIG. 6 shows an embodiment of the acoustic resistance element 31 in accordance with the invention wherein the material around the end 31E of the cup is doubled back to form a reinforced rim 31F; and, also to provide a better definition of the aperture area through which sound is to pass. The rim 31F can be formed by fusing the outside wall sections by heat, or by a solvent, while protecting or properly shielding the aperture area.

Figure 7:
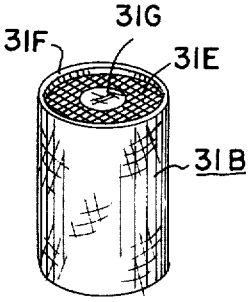
FIG. 7 shows an embodiment of the invention wherein the center portion of the mesh or screen is fused together to thereby provide a selected acoustic resistance to sound passing through the screen; and, FIG. 8 is another embodiment of the invention showing a fused pattern on the mesh screen which pattern is formed to provide an exact desired acoustic resistance.

FIG. 7 shows another useful embodiment of the invention which will now be described.

Since it is not always feasible to obtain fiber materials having the exact fiber diameter and spacing to achieve the desired acoustic resistance, the structure of FIG. 7 is a means of increasing the effective acoustic resistance of the acoustic element 31. The overall impedance to sound passing through the mesh or matrix can be increased by fusing portions of the aperture area 31E such as at 31G. In FIG. 7, the size or area of the fused portion 31G determines the increase in acoustical resistance. By fusing the central portion of the area, the total area of the aperture available for passage of sound is effectively decreased thereby increasing the impedance of the acoustical element while yet obtaining a minimum addition to the inertance component of the impedance as the sound is refracted around the sealed-off area.

Figure 8:
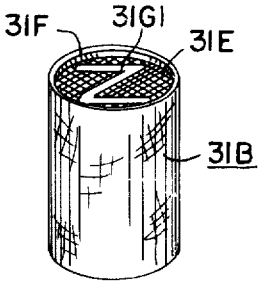

FIG. 8 shows another embodiment of the invention in which the aperture portion 31E has a pattern 31G1 formed thereon in accordance with a selected acoustical resistance required. More specifically, a fusing action is provided to the mesh or matrix 31E concurrently or alternatively as the acoustic resistance of the mesh 31E is being monitored. When the monitored acoustic resistance equals a desired total resistance, the fusing action is terminated.

In various prior art devices, in order to obtain an increased acoustic resistance, sound was caused to pass through a narrow hole or constriction. A principle feature of the present invention is that maximum use is made of the entire aperture area for sound flow. As mentioned above, the use of the entire aperture area for sound flow provides an acoustic impedance element wherein the inertance component of the impedance is lower and the acoustic element provides a better resistance; and also, for sound of high intensity the acoustic turbulence and noise is thereby minimized.

The inventive acoustic resistance element 31 can be crushed or collapsed without serious damage, and it can easily be restored to its original shape by unfolding the collapsed element, or by inserting the collapsed element over a mandrel and reforming it to its initial cup-like shape. The acoustic resistance element of the invention thus provides a removable, crush proof element which provides a selected acoustic resistance.

The invention has been particularly shown and described with reference to preferred embodiments and the claims define the scope thereof.

What is claimed is:

1. An acoustic cup-like plug for positioning in an acoustical port; said plug being of a resilient material of fiber mesh or screen, the sides of the cup-like plug being fused to obtain a cylindrical wall, said wall being substantially acoustically impervious for cooperating with the sides of the associated port to form an acoustical seal therebetween, the screen end of said cup-like plug positioned substantially parallel to the plane of the port opening for providing a maximum area for the passage of sound while effecting a selected acoustical resistance, the fibers in the end of the plug being fused in discrete sections for selectively determining the acoustical resistance provided by the screen end of said cup to sound passing therethrough, and the plug being readily restorable to its initial shape if distorted whereby the member may be conveniently handled, shipped and cleaned.

* * * * *